US007921475B2

(12) United States Patent
Nascimento et al.

(10) Patent No.: US 7,921,475 B2
(45) Date of Patent: Apr. 12, 2011

(54) IMPACT ATTENUATING CHIN PROTECTOR

(75) Inventors: Christopher J. Nascimento, Beaverton, OR (US); Dave M. Harbour, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 1526 days.

(21) Appl. No.: 11/294,276

(22) Filed: Dec. 5, 2005

(65) Prior Publication Data

US 2007/0124842 A1 Jun. 7, 2007

(51) Int. Cl.
*A42B 1/06* (2006.01)

(52) U.S. Cl. ..... 2/410; 2/424

(58) Field of Classification Search ..... 2/410, 411, 2/421, 9, 424, 6.6
See application file for complete search history.

(56) References Cited

U.S. PATENT DOCUMENTS

| | | | | |
|---|---|---|---|---|
| 1,262,818 | A | | 4/1918 | McGill |
| 2,250,275 | A | | 7/1941 | Riddell |
| 2,867,811 | A | | 1/1959 | Jones |
| 2,898,596 | A | | 8/1959 | Keen |
| 3,187,342 | A | | 6/1965 | Aileo |
| 3,216,023 | A | | 11/1965 | Morgan |
| 3,327,316 | A | | 6/1967 | Pukish, Jr. |
| 3,619,813 | A | | 11/1971 | Marchello |
| 3,787,895 | A | | 1/1974 | Belvedere |
| 3,916,446 | A | | 11/1975 | Gooding |
| 4,044,400 | A | | 8/1977 | Lewicki et al. |
| 4,461,044 | A | | 7/1984 | Reiterman et al. |
| 4,646,368 | A | | 3/1987 | Infusino et al. |
| 4,651,356 | A | | 3/1987 | Zide |
| 4,741,054 | A | | 5/1988 | Mattes |
| 4,829,599 | A | | 5/1989 | Giorgio et al. |
| 5,250,345 | A | * | 10/1993 | Chu ..... 428/156 |
| 5,347,660 | A | | 9/1994 | Zide et al. |
| 5,500,951 | A | * | 3/1996 | Marchello ..... 2/455 |
| 5,794,274 | A | | 8/1998 | Kraemer |
| 5,914,661 | A | * | 6/1999 | Gross ..... 340/600 |
| 6,298,483 | B1 | | 10/2001 | Schiebl et al. |
| 6,453,476 | B1 | * | 9/2002 | Moore, III ..... 2/412 |
| 6,481,024 | B1 | | 11/2002 | Grant |

FOREIGN PATENT DOCUMENTS

DE 196 42 572 A1 4/1997

* cited by examiner

*Primary Examiner* — Shaun R Hurley
*Assistant Examiner* — Andrew W Sutton
(74) *Attorney, Agent, or Firm* — Plumsea Law Group, LLC

(57) ABSTRACT

An impact attenuating chin protector comprises a hard outer shell with a narrowed central area to better dissipate impact forces and an inner foam member. The foam member includes a series of alternating foam columns and recesses with perforations at controlled locations to provide additional force dissipation, improved ventilation, and protection from the edges of the hard outer shell. The interior surface of the foam member is configured so that almost the entire interior surface contacts the wearer's chin except for the perforations. The columns and recesses are configured so that recesses are located around two pressure points on the chin. Since the columns absorb the impact of a collision, the two pressure points on the wearer's chin are not directly impacted. The outer shell does not completely cover the foam member leaving the upper and lower edges of the foam member to extend beyond the edges of the shell.

21 Claims, 6 Drawing Sheets

IMPACT ATTENUATING CHIN PROTECTOR

BACKGROUND OF THE INVENTION

1. Field of the Invention

An impact attenuating chin protector for use with athletic helmets such as football helmets to both protect the wearer and secure the helmet to the wearer's head.

2. Background of the Invention

Most athletic helmets are outfitted with a chin strap to secure the helmet to the wearer's head. For certain sports, it is necessary to protect the wearer from impact to the head, and more specifically to protect the chin of the wearer. Sports such as football and ice hockey involve collisions and blows to the head and face of the wearer. For these sports, a mere chin strap is not enough protection. Typically, for contact sports, a padded chin protector has been added to the chin strap to protect the wearer. Football in particular involves impact to the wearer's head that requires serious protection.

Football helmets have typically been provided with some sort of cushioned chin cup attached to the chin straps. Conventional chin cups are designed to be close fitting and are usually cushioned to lessen the shock of an impact to the wearer's chin. Chin cups generally include an outer shell having a concave shape to cradle a wearer's chin. The cushioning material is either suspended from the chin straps or attached to the outer, more rigid shell. The cushioning material is generally uniform through the cup with some provision in the prior art for ventilation. Some prior art chin cups also include a fabric liner for the face-contacting surface for comfort.

The outer shells of conventional chin cups are shaped to cradle and protect the chin when impacted. The strength of the outer shell has been improved with more advanced materials. Aside from advances in the choice of materials, the focus of the outer shell design has typically been to withstand impact forces. An opportunity to attenuate the impact is lost unless the outer shell is designed to deflect and thereby dissipate the forces from the impact.

One of the drawbacks of conventional chin cups is that even if they are cushioned, there is little consideration for the anatomy of the face and chin in their design. For high impact activities such as football in particular, it is as important to cushion the head as it is to attenuate the force of the collision or blow. Conventional chin cups are not designed to direct or channel the force of the collision. Cushioning can help absorb some of the impact, but there has been a lack of attention in prior designs with avoiding direct impact to certain sensitive areas of the wearer's face Another drawback of conventional chin cups is a matter of comfort. Small pinholes in a cushioning member or plastic member as has been used in conventional chin cups do not provide sufficient ventilation to the wearer's face. Without proper ventilation and wicking of perspiration, the chin cup can become wet and prone to slipping resulting in a dangerous situation. In addition, the contact between the chin cups and the face can become a source of irritation when the contact area involves a large surface area.

SUMMARY

The impact attenuating chin protector of the present invention comprises a hard outer shell designed to dissipate impact forces and an inner slow return foam member. In elevation, the outer shell has a narrowed central area. This geometry enables the outer shell to deflect more on impact to dissipate the forces of impact. The foam member is molded with a series of foam columns and recesses with perforations at controlled locations to provide additional force dissipation, improved ventilation, and protection from the edges of the hard outer shell. The chin protector is also designed to reduce the likelihood of sliding off due to perspiration.

The present invention improves upon existing chin cups in least the following ways: the geometries of the outer shell and inner foam member each contribute to shock deflection and absorption characteristics; the interface between the two components enhances ventilation and comfort; and the configuration of the inner foam member ensures that particularly sensitive areas of the wearer's chin do not receive a direct impact while providing proper ventilation.

The geometry of the outer shell is designed to deflect upon impact. The narrowed central area enables the shell to flex more easily when impacted compared with conventional outer shell geometries. More flexure of the outer shell results in less impact to the wearer's head. The inner foam member has an outer periphery surrounding a series of alternating vertical columns and recesses along the exterior surface. The recesses include perforations to enhance ventilation. The interior surface of the foam member is configured so that almost the entire interior surface contacts the wearer's chin except for the perforations. The columns and recesses are configured so that recesses are located around two pressure points on the chin. Since the columns absorb the impact of a collision, the two pressure points are not directly impacted.

In addition, the outer shell does not completely cover the foam member, but instead the foam member extends beyond the upper and lower edges of the outer shell. The portions of the foam member which extend beyond the outer shell are not attached to the shell at all. This provides an increased surface area to contact the wearer's face, and to better provide force dissipation upon impact. The upper and lower ends of most of the columns, recesses and perforations are also not covered by the outer shell. This configuration enhances ventilation as at least some of the perforations are open to the air. In addition, the perforations channel perspiration away from the wearer's skin to the outside.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 4:
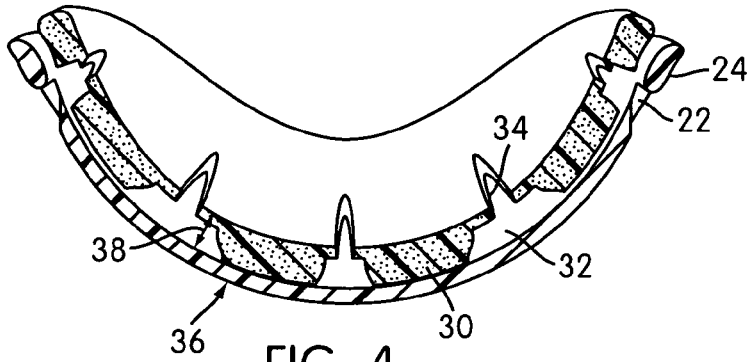
FIG. 4 is a horizontal cross-section of the chin protector taken along line 4-4 of FIG. 2.
Figure 5:
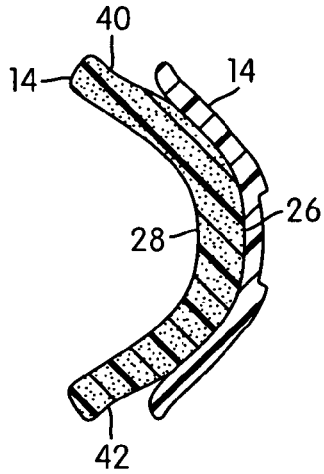
FIG. 5 is a vertical cross-section of the chin protector taken along line 5-5 of FIG. 2.
Figure 6:
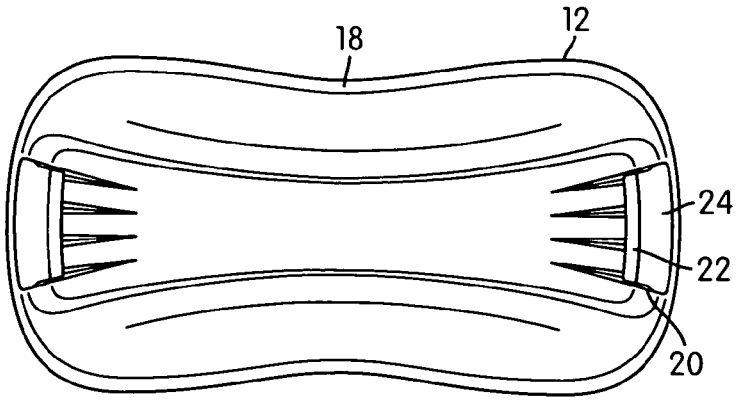
FIG. 6 is a front elevational view of the outer shell of the chin protector.
Figure 7:
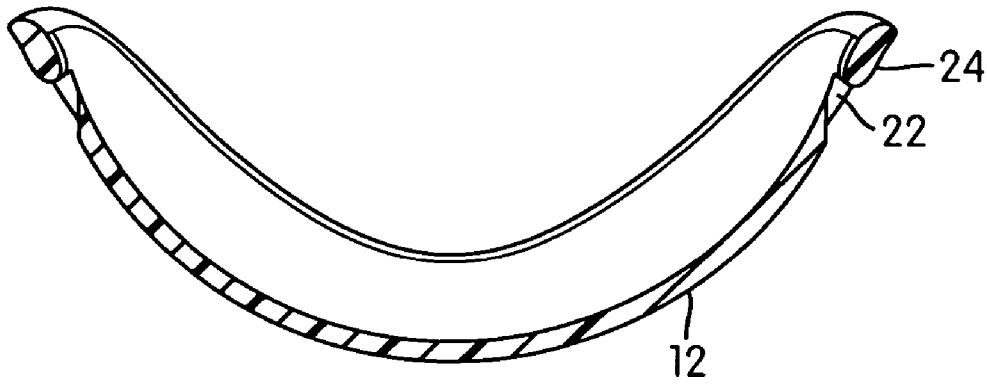
FIG. 7 is a top plan view of the outer shell.
Figure 8:
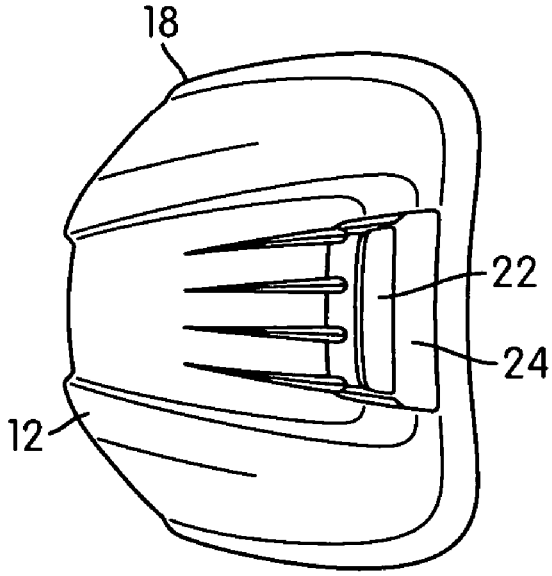
FIG. 8 is a side elevational view of the outer shell.
Figure 9:
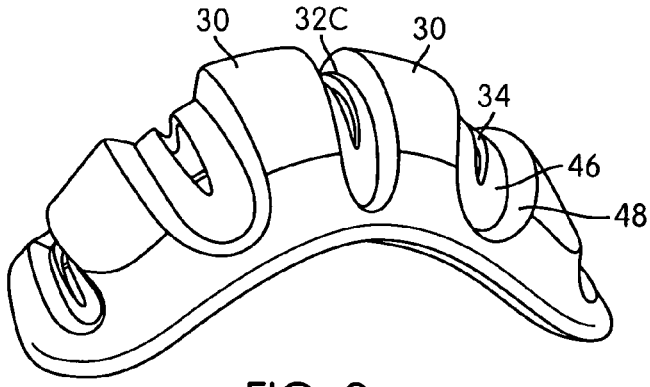
FIG. 9 is a perspective view of the inner foam member of the chin protector.
Figure 10:
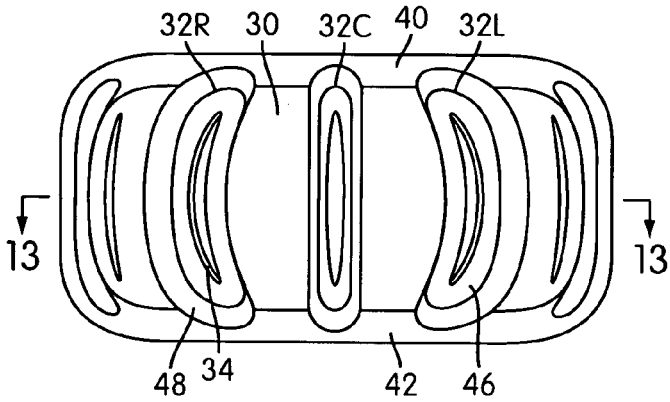
FIG. 10 is a front elevational view of the inner foam member.
Figure 11:
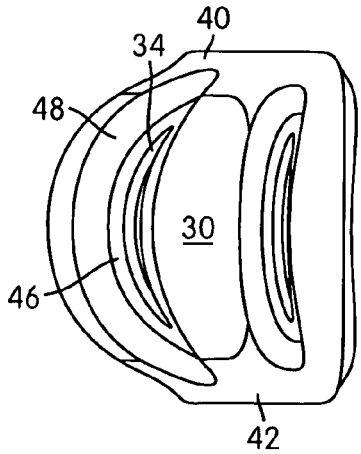
FIG. 11 is a side elevational view of the inner foam member.
Figure 12:
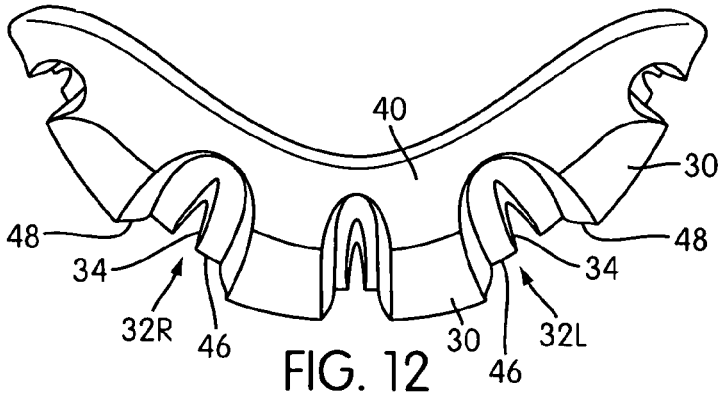
FIG. 12 is a top plan view of the inner foam member.
Figure 13:
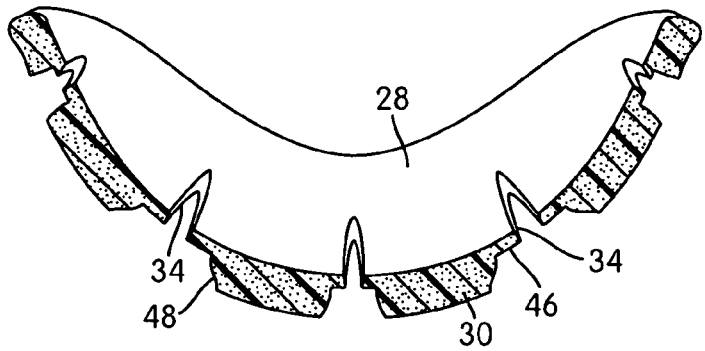
FIG. 13 is a cross-section of the foam portion taken along line 13-13 of FIG. 10.
Figure 14:
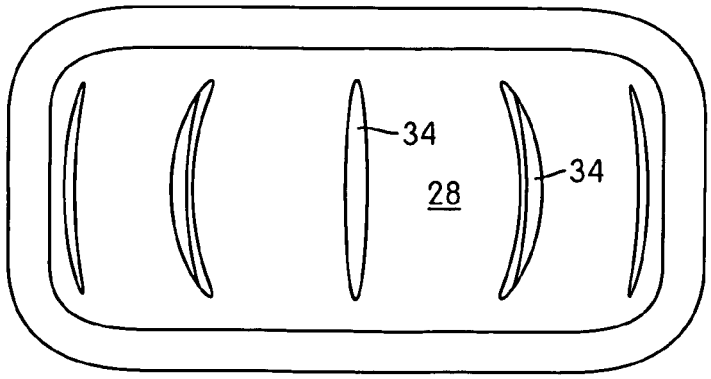
FIG. 14 is an elevational view of the interior of the inner foam member.
Figure 15:
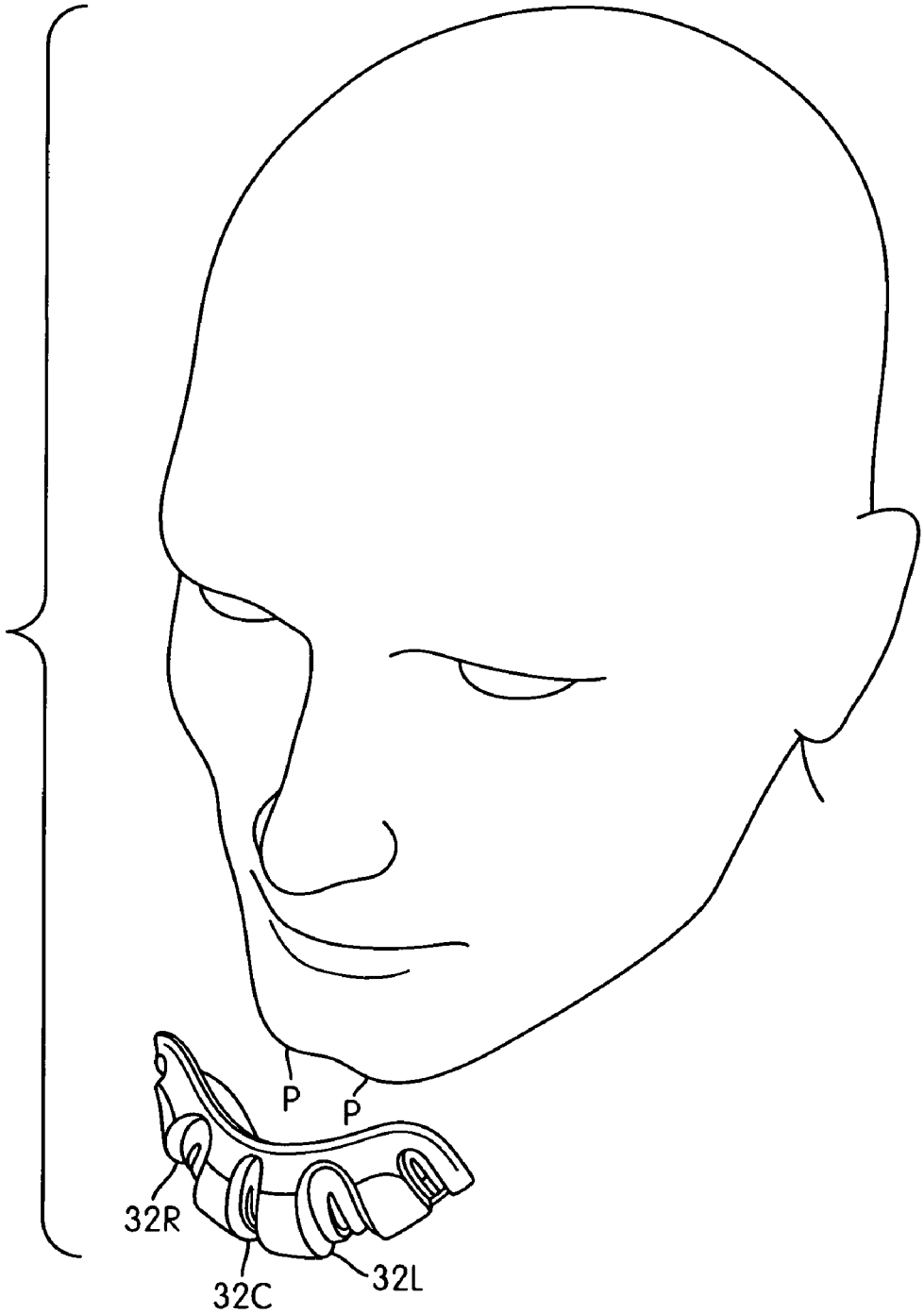
FIG. 15 is schematic of a wearer's head with the foam portion shown in assembly view to illustrate the facial pressure points.

Chin protector 10 comprises an outer shell 12, an inner foam member 14, and straps 16. FIGS. 1-5 illustrate chin cup 10 with inner foam member 14. FIGS. 6-8 illustrate outer shell 12 in isolation, and FIGS. 9-14 illustrate inner foam member 14 in isolation. FIG. 15 illustrates the placement of inner foam member 14 on a wearer's face. Referring to FIGS. 1-5, outer shell 12 has an exterior convex surface, and correspondingly, an interior concave surface. As best seen in elevation, outer shell 12 has a narrowed central area 18 lending the outer shell a slightly bow-tie shape. Narrowed central area 18 enables outer shell 12 to flex more readily upon impact than a cup of uniform outline. Flexure of the outer shell upon helps dissipate the impact forces and enhances the shock attenuating properties of the chin protector. The outer shell is made of a resilient material such as ABS (Acrylonitrile Butadiene Styrene) plastic.

Outer shell 12 includes integral lugs 20 at the distal ends for receiving straps 16. Each lug 20 includes a vertically oriented slot 22 for receiving the strap, and a distal bearing surface 24. Bearing surface 24 is disposed along a curvature to provide a smooth contact and guide surface for strap 16. Outer shell 12 may also include ventilation openings at suitable locations.

Inner foam member 14 is integrally molded to have a convex exterior surface 26 and a corresponding concave interior surface 28, FIGS. 9-14. Convex exterior surface 26 is shaped to correspond and mate within the concave cup formed by outer shell 12. Exterior surface 26 includes integrally molded vertical columns 30 alternating with vertical recesses 32. Each of the recesses has an elongated, vertically oriented elliptical perforation 34 venting from interior surface 28 to exterior surface 26. The nested arrangement of outer shell 12 and inner foam member 14 is best seen in FIGS. 4 and 5. Inner foam member 14 is received in outer shell 12 such that columns 30 contact the interior surface of the outer shell and are attached thereto by an adhesive or the like. Each column 30 of inner foam member 14 abuts against the interior surface of the outer shell such that upon impact, shown by vector 36, columns 30 absorb and deflect the force of the impact, FIG. 4. This is because columns 30 increase the distance between the wearer's chin, i.e., interior surface 28 of inner foam member 14, and outer shell 12. This distance is marked with reference numeral 38 in FIG. 4. Naturally, increasing the space between the outer shell and the wearer's chin provides more distance for the inner foam to retract upon collision thereby providing increased attenuation of the impact forces.

Inner foam member 14 has a top surface 40 and a bottom surface 42. Recesses 32 are provided between columns 30 on exterior surface 26 of inner foam member 14. Each recess extends into top surface 40 and bottom surface 42, and terminates with a rounded curvature 44 at these ends. Each recess extends depth-wise into the foam to middle surface 46 which forms the floor or inner wall of the recess. Transition surfaces 48 between exterior surface 26 and this middle surface 46 are beveled or curved, thereby providing a beveled or curved side wall to each column 30. Transition surfaces 48 also enhance smooth attenuation of the impact as the columns compress.

Referring to FIG. 15, the chin has symmetrical pressure points labeled P on either side of center along the chin bone. The chin bone will experience less trauma if these pressure points are not directly impacted. Therefore, the locations of columns 30 and recesses 32 are determined in order to direct and dissipate impact forces around pressure points P. Specifically, a central recess 32C is narrower than left and right recesses 32L and 32R, so that the columns immediately adjacent central recess 32C are located between pressure points P. As a result, left and right recesses 32L and 32R correspond to the locations of pressure points P. Moving away from the center of the chin, more columns 30 flank recesses 32L and 32R toward the jaw. Placing pressure points P between the columns prevents those points from receiving the direct impact of a collision. This decreases the chances of traumatic injury to the wearer's chin and jaw. As seen in FIG. 4, the greatest distance 38 occurs at the two central columns to absorb and dissipate impact forces. As also seen best in FIG. 4, the widest recesses are 32L and 32R. This ensures that pressure points P will be located in recesses 32L and 32R for a range of chin sizes.

An elliptical cut-out or perforation 34 is disposed in a vertical orientation in each of the recesses. Each perforation 34 is long enough so that the ends extend to top and bottom surfaces 40 and 42. As seen in FIG. 14, interior surface 28 of inner foam member 14 is the skin contacting surface. It can be seen from FIG. 14, interior surface 28 presents a large surface area for contact with the wearer's chin to ensure a secure fit. A functional benefit of the perforations is that they provide a variance in the surface texture of interior surface 28 which will increase friction on the wearer's skin and reduce the chance of the chin protector sliding off of the chin during collisions. The relative large amount of surface area of interior surface 28 in contact with the wearer's chin is also an advantage from a comfort standpoint.

Figure 1:
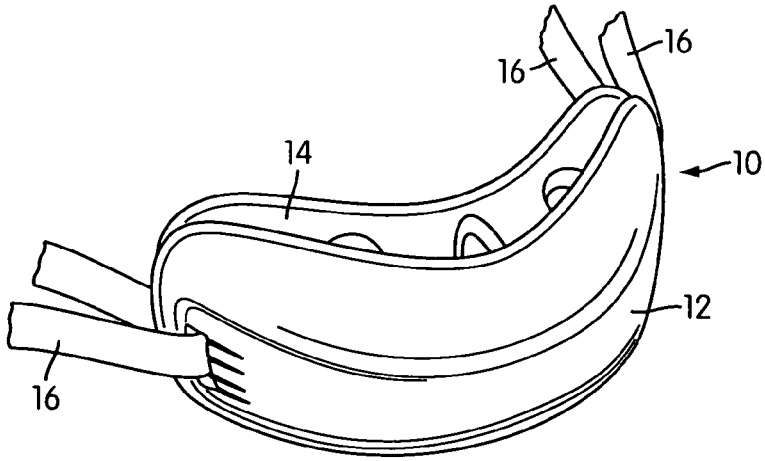
FIG. 1 is a perspective view of a shock attenuating chin protector in accordance with the present invention.
Figure 2:
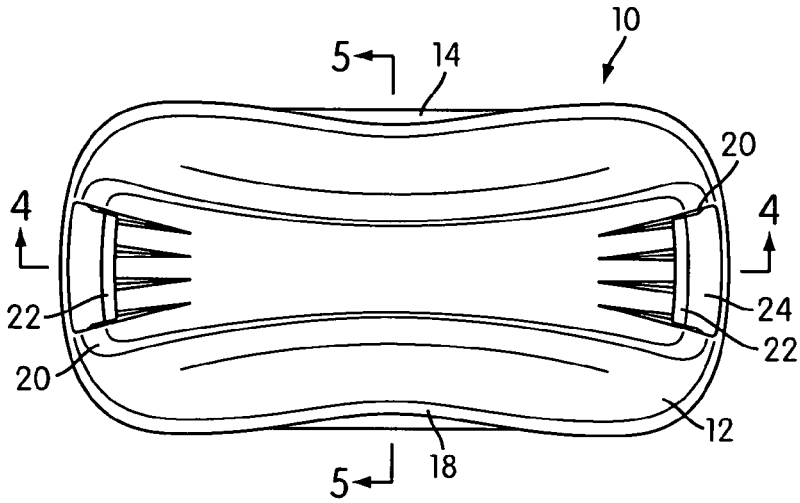
FIG. 2 is a front elevational view of the chin protector.
Figure 3:
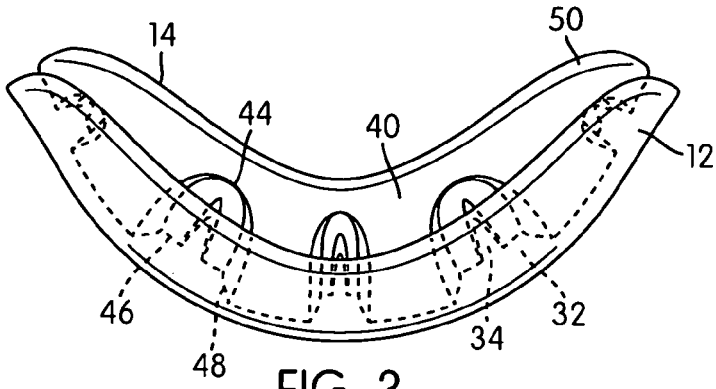
FIG. 3 is a top plan view of the chin protector.

Inner foam member 14 is comprised of a durable, slow return foam such as EVA, Ethylene Vinyl Acetate, or the like. Interior surface 28 may be left as is, or may optionally have attached thereto a layer of fabric or other material for comfort. FIG. 3 illustrates a liner layer 50 on interior surface 28. Liner layer 50 preferably has moisture wicking properties, such as Nike Dri-FIT™, for enhanced comfort.

Another aspect of the present chin protector is in the interface between outer shell 12 and inner foam member 14. Inner foam member 14 is sized and proportioned so that a portion of top and bottom surfaces 40 and 42 are not covered by outer shell 12, FIGS. 1 and 3. This ensures that the ends of at least central recess 32C, and left and right recesses 32L and 32R are exposed when at rest, which in turn ensures that the ends of the perforations corresponding to these recesses are also exposed. Exposing the perforations provides ventilation to the chin and channels heat and moisture away from the chin.

Columns 30 are adhered to outer shell 12 along their substantially vertical surfaces, and the top and bottom surfaces of foam member 14 are not attached to the outer shell nor do they even touch the outer shell at rest, FIG. 5. This configuration is advantageous because it provides more surface area for contact with the wearer's chin, and at the same time increases the distance between the wearer's chin and the outer shell to thereby reduce the risk of injury.

The chin protector of the present invention is designed to attenuate the shock of a collision impact on the chin (i) by deflection of the outer shell upon impact to dissipate the forces; (ii) by providing an increased distance between the shell and the chin via the inner foam member; (iii) by shock absorption due to compression of the columns of the inner foam member; and (iv) by ensuring that impact forces are not directly felt by the pressure points on the chin. In addition to attenuating the shock of impact, the chin protector of the present invention also includes structural features to ensure that the protector stays on the wearer's chin during a collision: an increased surface area contacting the chin; and surface texture variance to increase friction on the interior surface. The configuration of the recesses and perforations with their ends exposed along the top and bottom also enhances ventilation and channeling of heat and moisture away from the chin. This is a safety and comfort improvement since eliminating moisture also reduces the likelihood of slippage.

While various embodiments of the invention have been described, it will be apparent to those of ordinary skill in the art that may more embodiments and implementations are possible that are within the scope of the invention.

What is claimed is:

1. An impact attenuating chin protector for athletic helmets comprising:

an outer shell having a convex outer surface, a concave inner surface and having slots at distal ends thereof;

an inner foam member also having a convex outer surface and a concave inner surface, said convex outer surface of said foam member received in and attached to said concave inner surface of said outer shell, said foam member including a series of vertically oriented alternating force dissipation columns and middle surfaces recessed from said convex outer surface; and fastening straps received in said slots for fastening said chin protector to an athletic helmet;

wherein said force dissipation columns and said middle surfaces form recesses between adjacent ones of said force dissipation columns when said inner foam member is in a substantially uncompressed state.

2. The chin protector of claim 1, wherein a ventilation perforation is provided in each of said recesses, and said ventilation perforation extends to said middle surface.

3. An impact attenuating chin protector for athletic helmets comprising:

an outer shell having a convex outer surface, a concave inner surface and having slots at distal ends thereof;

an inner foam member also having a convex outer surface and a concave inner surface, said convex outer surface of said foam member received in and attached to said concave inner surface of said outer shell, said foam member including a series of vertically oriented alternating force dissipation columns and recesses extending across said convex outer surface thereof with a ventilation perforation provided in each of said recesses; and fastening straps received in said slots for fastening said chin protector to an athletic helmet;

wherein each said recess comprises a middle surface recessed from said convex outer surface of said inner foam member, wherein said ventilation perforation extends to said middle surface, and further comprising a beveled transition surface between said middle surface and said convex outer surface.

4. The chin protector of claim 2, wherein each said ventilation perforation is an elliptical cut-out.

5. The chin protector of claim 1, wherein said inner foam member extends beyond said outer shell.

6. The chin protector of claim 5, wherein a portion of at least one of said recesses extends beyond said outer shell and is exposed.

7. The chin protector of claim 6, wherein a portion of at least one of said ventilation perforations extends beyond said outer shell and is exposed to ventilate a wearer's face and channel moisture outward.

8. An impact attenuating chin protector for athletic helmets comprising:

an outer shell having a convex outer surface, a concave inner surface and having slots at distal ends thereof;

an inner foam member also having a convex outer surface and a concave inner surface, said convex outer surface of said foam member received in and attached to said concave inner surface of said outer shell, said foam member including a series of vertically oriented alternating force dissipation columns and recesses extending across said convex outer surface thereof with a ventilation perforation provided in each of said recesses; and fastening straps received in said slots for fastening said chin protector to an athletic helmet;

wherein said inner foam member and said outer shell are attached to one another only along a vertical portion of at least one of said columns, and at least said top and bottom surfaces of said inner foam member are unattached to said outer shell.

9. The chin protector of claim 1, wherein said columns and said recesses are configured to locate at least one of said recesses to correspond to a pressure point on a wearer's chin.

10. The chin protector of claim 1, wherein said outer shell includes a narrowed central area to facilitate dissipation of impact forces.

11. The chin protector of claim 10, wherein said inner foam member extends beyond said outer shell.

12. The chin protector of claim 11, wherein a portion of at least one of said recesses extends beyond said outer shell and is exposed.

13. The chin protector of claim 12, wherein a portion of at least one of said ventilation perforations extends beyond said outer shell and is exposed to ventilate a wearer's face and channel moisture outward.

14. An impact attenuating chin protector for athletic helmets comprising:

an outer shell having a convex outer surface, a concave inner surface and having slots at distal ends thereof;

an inner foam member also having a convex outer surface and a concave inner surface, said convex outer surface of said foam member received in and attached to said concave inner surface of said outer shell, said foam member including a series of vertically oriented alternating force dissipation columns and recesses extending across said convex outer surface thereof with a ventilation perforation provided in each of said recesses; and fastening straps received in said slots for fastening said chin protector to an athletic helmet;

wherein said outer shell includes a narrowed central area to facilitate dissipation of impact forces, said inner foam member and said outer shell are attached to one another along a vertical portion of at least one of said columns, and at least said top and bottom surfaces of said inner foam member are unattached to said outer shell.

15. An impact attenuating chin protector for athletic helmets comprising:

an outer shell comprising a convex outer surface, a concave inner surface, a narrowed central area to facilitate dissipation of impact forces, and having slots at distal ends thereof;

an inner foam member also having a convex outer surface and a concave inner surface, said convex outer surface of said foam member received in and attached to said concave inner surface of said outer shell, said foam member including a series of vertically oriented alternating force dissipation columns and recesses extending across said convex outer surface thereof with a ventilation perforation provided in each of said recesses; and fastening straps received in said slots for fastening said chin protector to an athletic helmet;

wherein said inner foam member extends beyond said outer shell and a portion of at least one of said recesses extends beyond said outer shell and is exposed.

16. The chin protector of claim 15, wherein said columns and said recesses are configured to locate at least one of said recesses to correspond to a pressure point on a wearer's chin.

17. The chin protector of claim 16, wherein each said recess comprises a middle surface recessed from said convex outer surface of said inner foam member, wherein said ventilation perforation extends to said middle surface.

18. The chin protector of claim 17, further comprising a beveled transition surface between said middle surface and said convex outer surface.

19. The chin protector of claim 15, wherein each said ventilation perforation is an elliptical cut-out.

20. The chin protector of claim 15, wherein a portion of at least one of said ventilation perforations extends beyond said outer shell and is exposed to ventilate a wearer's face and channel moisture outward.

21. An impact attenuating chin protector for athletic helmets comprising:

an outer shell comprising a convex outer surface, a concave inner surface, a narrowed central area to facilitate dissipation of impact forces, and having slots at distal ends thereof;

an inner foam member also having a convex outer surface and a concave inner surface, said convex outer surface of said foam member received in and attached to said concave inner surface of said outer shell, said foam member including a series of vertically oriented alternating force dissipation columns and recesses extending across said convex outer surface thereof with a ventilation perforation provided in each of said recesses; and fastening straps received in said slots for fastening said chin protector to an athletic helmet;

wherein said inner foam member and said outer shell are attached to one another along a vertical portion of at least one of said columns, and at least said top and bottom surfaces of said inner foam member are unattached to said outer shell.

* * * * *